US005671812A

United States Patent [19]

Bridges

[11] Patent Number: 5,671,812

[45] Date of Patent: Sep. 30, 1997

[54] HYDRAULIC PRESSURE ASSISTED CASING TENSIONING SYSTEM

[75] Inventor: Charles D. Bridges, Cypress, Tex.

[73] Assignee: ABB Vetco Gray Inc., Houston, Tex.

[21] Appl. No.: 626,896

[22] Filed: Apr. 4, 1996

Related U.S. Application Data

[63] Continuation-in-part of Ser. No. 450,241, May 25, 1995, abandoned.

[51] Int. Cl.[6] ..... E21B 33/043

[52] U.S. Cl. ..... 166/348; 166/368; 166/381

[58] Field of Search ..... 166/348, 208, 166/367, 368, 382, 387; 285/141

[56] References Cited

U.S. PATENT DOCUMENTS

| | | | |
|---|---|---|---|
| 4,053,023 | 10/1977 | Herd et al. | 166/348 X |
| 4,607,865 | 8/1986 | Hughes | 285/141 X |
| 4,736,799 | 4/1988 | Ashtone | 166/348 |
| 4,880,061 | 11/1989 | Ashtone | 166/348 |
| 4,903,774 | 2/1990 | Dykes et al. | 166/368 X |
| 4,909,546 | 3/1990 | Nobileau . | |
| 4,949,786 | 8/1990 | Eckert et al. . | |
| 4,995,464 | 2/1991 | Watkins et al. . | |
| 5,002,131 | 3/1991 | Cromar et al. . | |
| 5,240,076 | 8/1993 | Cromar et al. . | |
| 5,240,081 | 8/1993 | Milberger et al. | 166/368 X |
| 5,255,746 | 10/1993 | Bridges . | |
| 5,311,947 | 5/1994 | Kent et al. . | |
| 5,372,201 | 12/1994 | Milberger | 166/348 X |
| 5,450,905 | 9/1995 | Brammer et al. | 166/348 |

OTHER PUBLICATIONS

Serial Number 08/285,577 filed Aug. 3, 1994.

*Primary Examiner*—Frank S. Tsay
*Attorney, Agent, or Firm*—James E. Bradley

[57] ABSTRACT

A tensioning system for a tieback string of casing between a subsea wellhead and a surface wellhead employs hydraulic pressure. A mandrel is connected into the tieback string. A casing hanger mounts to the mandrel and an internal gripping member between the casing hanger and the mandrel allows upward movement of the mandrel relative to the casing hanger but prevents downward movement. The operator lowers the string into the well with the casing hanger in an extended upward position and secures the tieback. The operator then closes the blowout preventer and applies hydraulic pressure in the annulus below the blowout preventer. Seals seal the casing hanger to the surface wellhead and also seal the inner diameter of the casing hanger to the running conduit. The hydraulic pressure forces the casing hanger down onto an internal landing shoulder in the surface wellhead.

19 Claims, 9 Drawing Sheets

HYDRAULIC PRESSURE ASSISTED CASING TENSIONING SYSTEM

CROSS REFERENCE TO RELATED APPLICATION

This application is a continuation-in-part of application Ser. No. 08/450,241, filed May 25, 1995, now abandoned.

BACKGROUND OF THE INVENTION

1. Field of the Invention

This invention relates in general to a system for tensioning a string of casing extending between a subsea wellhead and a surface wellhead located on an offshore platform, and in particular to a system utilizing an adjustable mandrel.

2. Description of the Prior Art

In certain types of offshore drilling, a string of casing will be connected between a subsea wellhead assembly at the sea floor and a surface wellhead at a platform located at the surface. For example, one technique involves drilling subsea wells with a floating drilling rig and leaving the wells cased but not completed for production. Later a production platform is installed over the subsea wellhead assemblies for completing the wells with surface wellheads at the platform. A tieback string of casing will be lowered from the platform and latched into the subsea assembly. The operator applies tension to the tieback string and adjusts a load shoulder at the surface wellhead for maintaining the tieback string in tension.

A number of different systems have been used and proposed in the past. Some of these systems employ a locking member which will ratchet on a mandrel in one direction and support weight in the other direction to maintain the string in tension. While these systems are workable, improvements to reduce cost and facilitate installation are desirable.

SUMMARY OF THE INVENTION

The system of this invention includes a mandrel which is attached into the string of casing. A casing hanger is attached to the mandrel by a gripping member which allows upward movement of the mandrel relative to the casing hanger but prevents downward movement of the mandrel relative to the casing hanger. The assembly is lowered through the riser and blowout preventer on a running string while the casing hanger is in an extended position relative to the mandrel. The lower end of the casing string is latched to the subsea wellhead while the casing hanger external shoulder is still spaced above a load shoulder of the surface wellhead.

The casing hanger and surface wellhead have seals which form a piston with an upper portion of the casing hanger. Closing the blowout preventer around the running string provides a sealed annulus above the casing hanger. Hydraulic pressure applied to the annulus forces the casing hanger downward onto the load shoulder. A latch retains the casing hanger on the load shoulder. After the casing hanger is on the load shoulder, the mandrel is pulled upward to apply tension to the string, and once tension is relaxed, the gripping member will grip the mandrel to support the string in tension.

DETAILED DESCRIPTION OF THE INVENTION

Figure 1A:
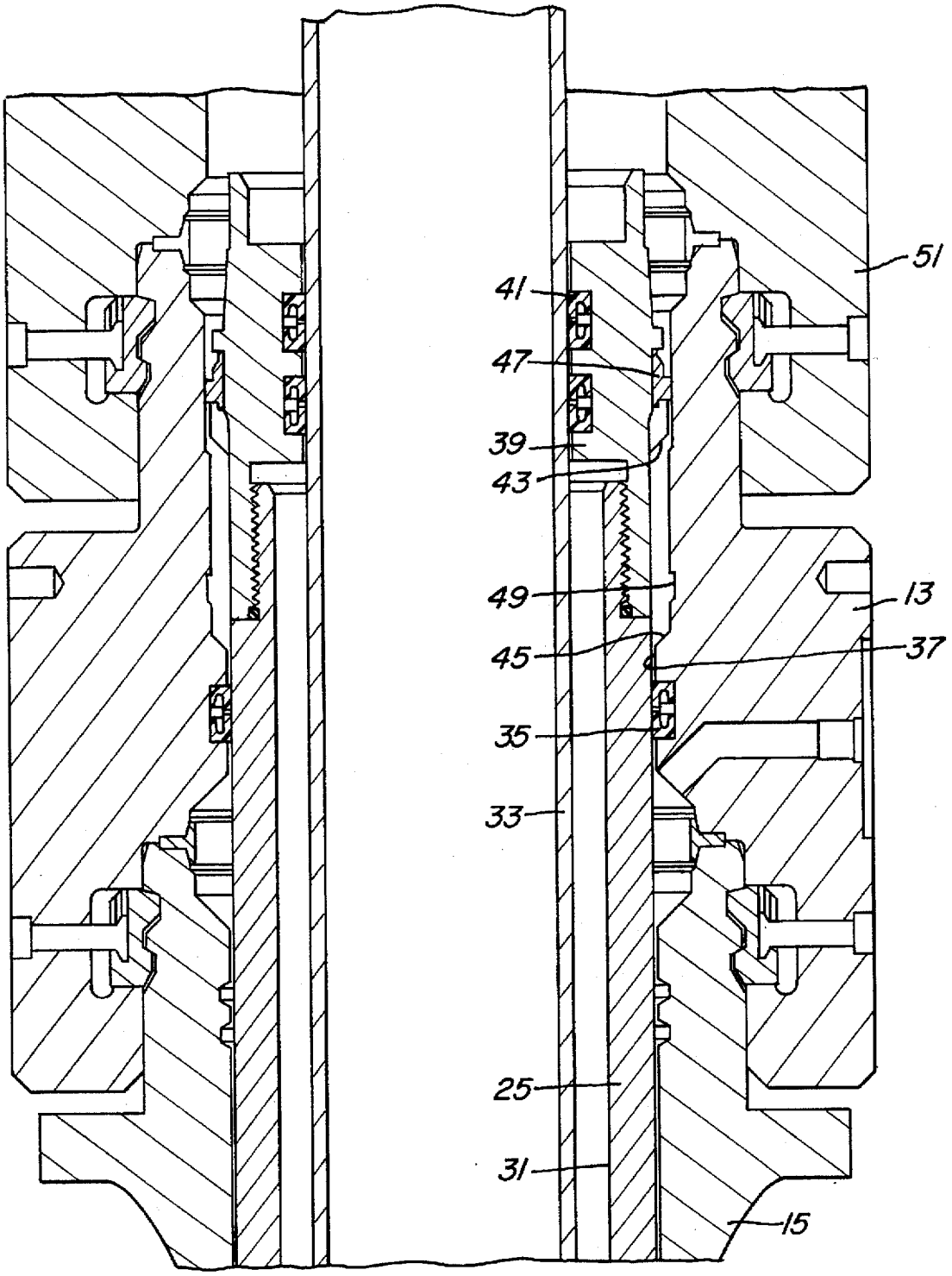
FIGS. 1A and 1B comprise a vertical sectional view illustrating a surface wellhead system constructed in accordance with this invention, and shown in a running-in position.
Figure 1B:
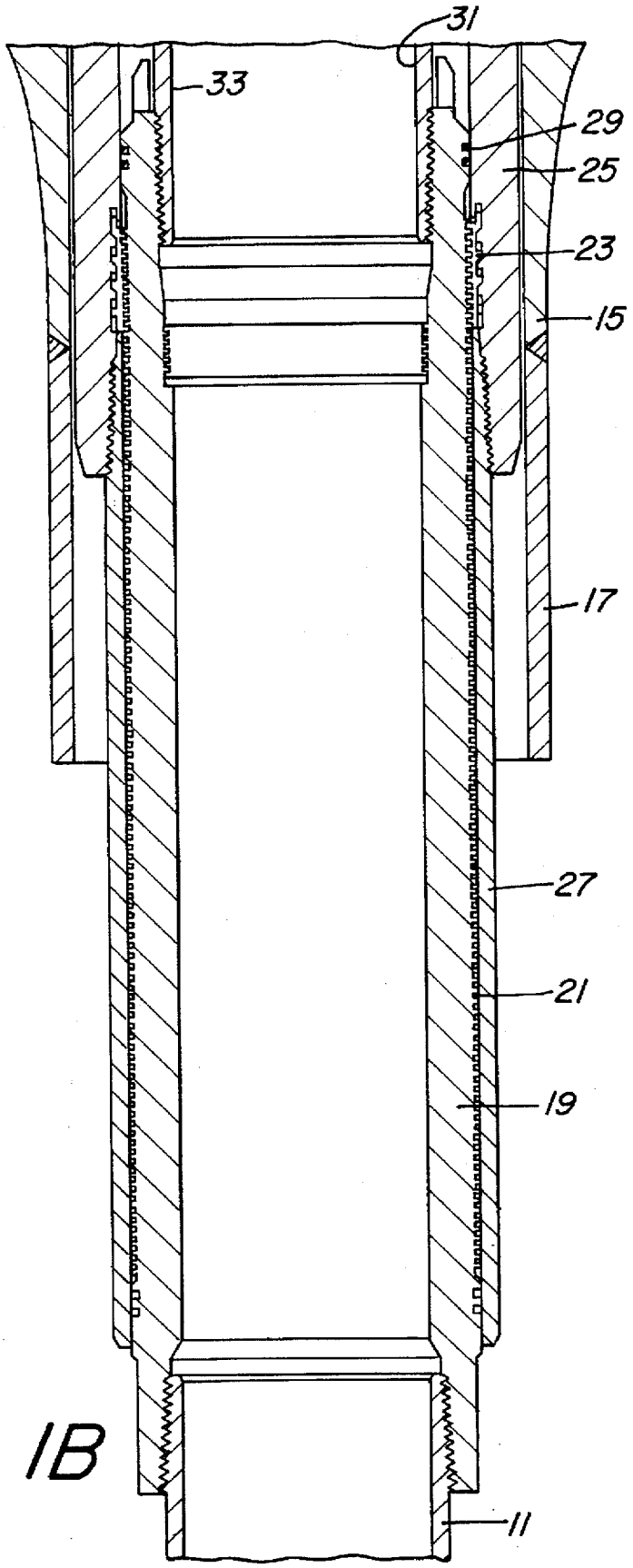

Referring to FIG. 1B, a tieback string 11 of casing will be latched into a subsea wellhead (not shown). The subsea wellhead will be located at the sea floor and at the upper end of a well which normally would have been previously drilled and cased by floating drilling vessel. Later, a production platform (not shown) is installed over a number of the wells. The platform may be supported on legs in compression or held in place by legs in tension.

A surface wellhead 13 (FIG. 1A) will be installed on the platform at a well deck. The well deck will be located about 90 feet below a rig floor (not shown). Surface wellhead 13 will be connected to the subsea well by a support housing 15 located at the upper end of large diameter riser or conductor 17. Tieback string 11 will be supported in tension by the surface wellhead 13.

Figure 5:
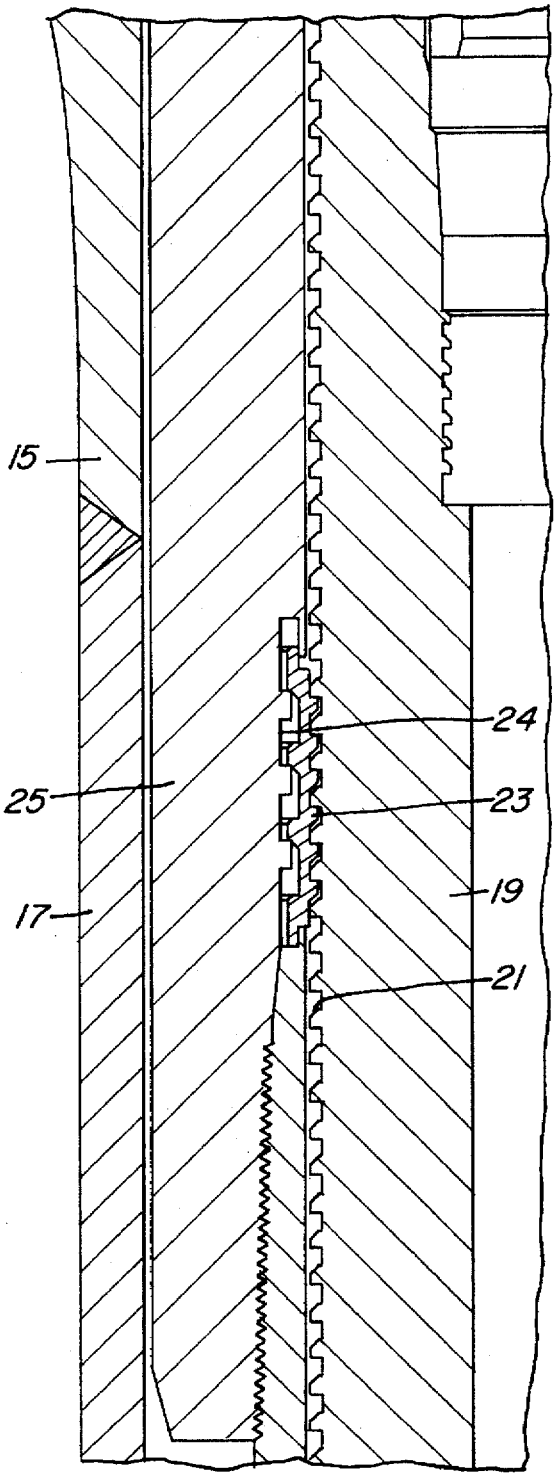
FIG. 5 is an enlarged partial sectional view of the ratchet mechanism between the casing hanger and mandrel of the wellhead system of FIG. 1.

Tensioning is accomplished with the use of a mandrel 19. Mandrel 19 has a plurality of grooves 21 on its exterior. As shown more clearly in FIG. 5, grooves 21 are saw-tooth shaped threads in the preferred embodiment. An expansible ratchet ring 23 has internal mating threads for mating with grooves 21. Ratchet ring 23 has external load shoulders for engaging load shoulders 24 within a casing hanger lower extension pipe 25. Ratchet ring 23 is of a type that is shown in U.S. Pat. No. 4,607,865, issued Aug. 26, 1986. Ratchet ring 23 ratchets to allow a straight downward movement of casing hanger lower extension 25 relative to mandrel 19. However, it will not allow downward movement of mandrel 19 relative to lower extension 25. A protective sleeve 27 secures to the lower end of lower extension 25 and surrounds grooves 21.

Referring again to FIG. 1B, mandrel 19 has an upper end which has seals 29 for sealingly engaging the bore 31 of lower extension 25. A running string of conduit 33 secures by threads to the upper end of mandrel 19. Conduit 33 in the preferred embodiment comprises sections of casing that are identical to the casing of tieback string 11. Conduit 33 initially extends upward to the rig floor and is used to lower mandrel 19 into surface wellhead 13.

Referring now to FIG. 1A, casing hanger lower extension 25 extends upward into surface wellhead 13. An elastomeric outer seal 35 locates in surface wellhead bore 37 for engaging lower extension 25. Seal 35 allows sliding movement of lower extension 25 relative to surface wellhead 13. A casing hanger 39 is secured by threads to lower extension pipe 25. Casing hanger 39 has a pair of inner seals 41 that are the same type as outer seal 35. Inner seals 41 seal to the outer diameter of conduit 33 and will allow sliding movement of conduit 33 relative to casing hanger 39. Seals 35, 41 are used only during the installation procedure, and afterward, have no sealing function.

Figure 2:
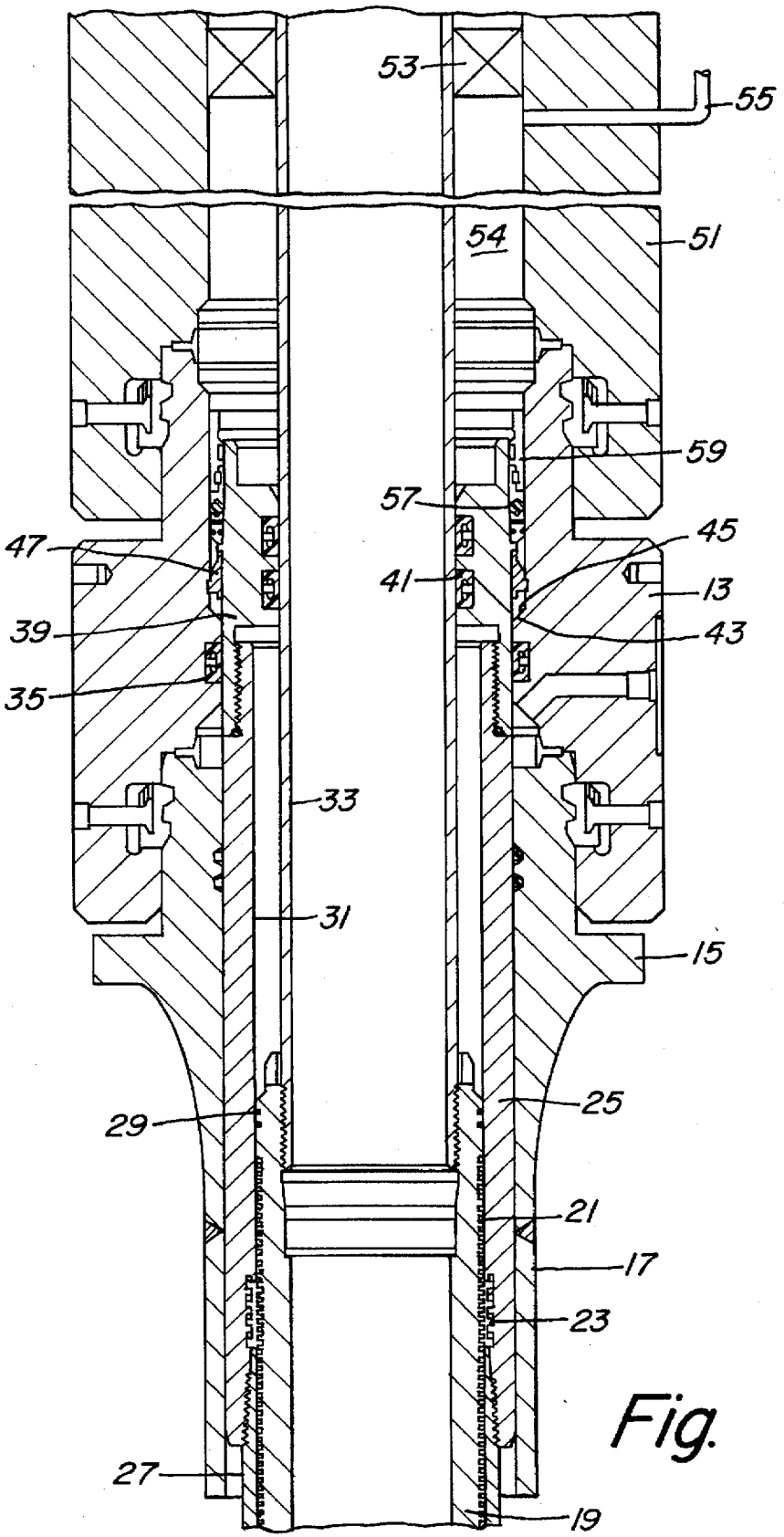
FIG. 2 is a vertical sectional view of the wellhead system of FIG. 1, showing the casing hanger in a landed position, but the casing not yet tensioned.
Figure 3:
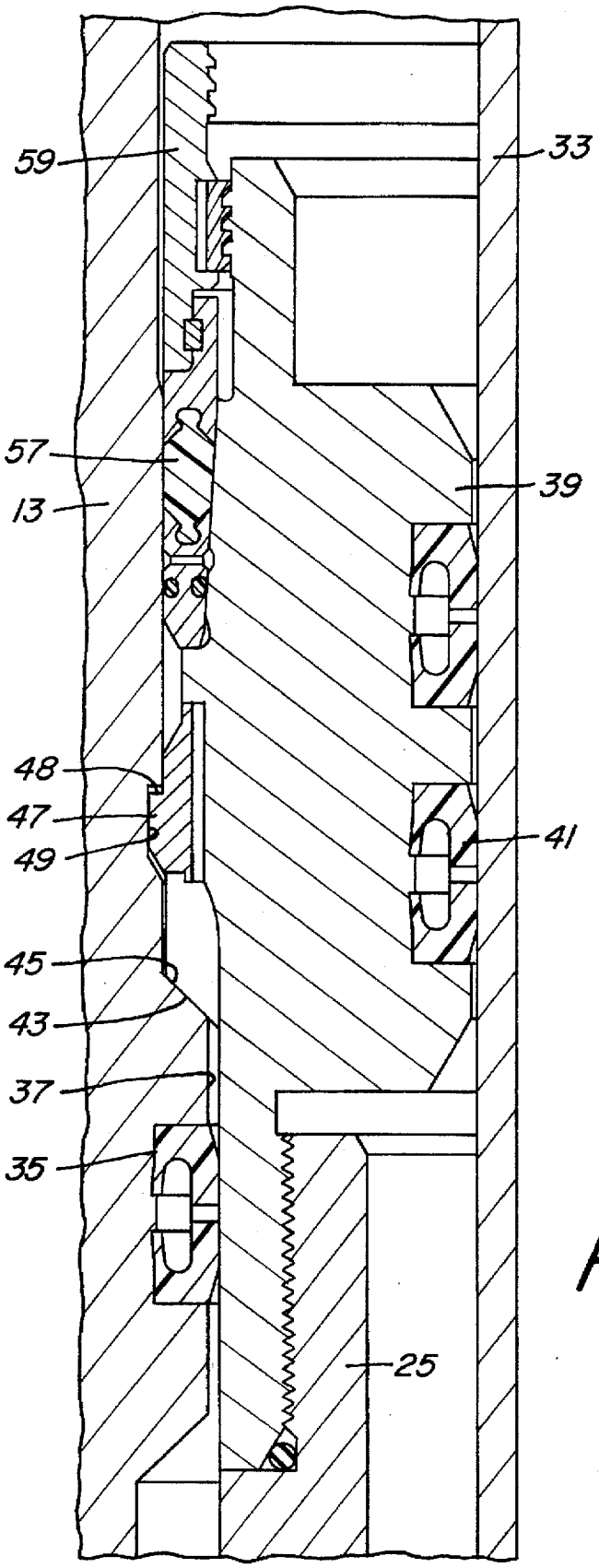
FIG. 3 is an enlarged partial sectional view of an upper portion of the casing hanger for the wellhead system of FIG. 1, showing an annulus seal installed.
Figure 4:
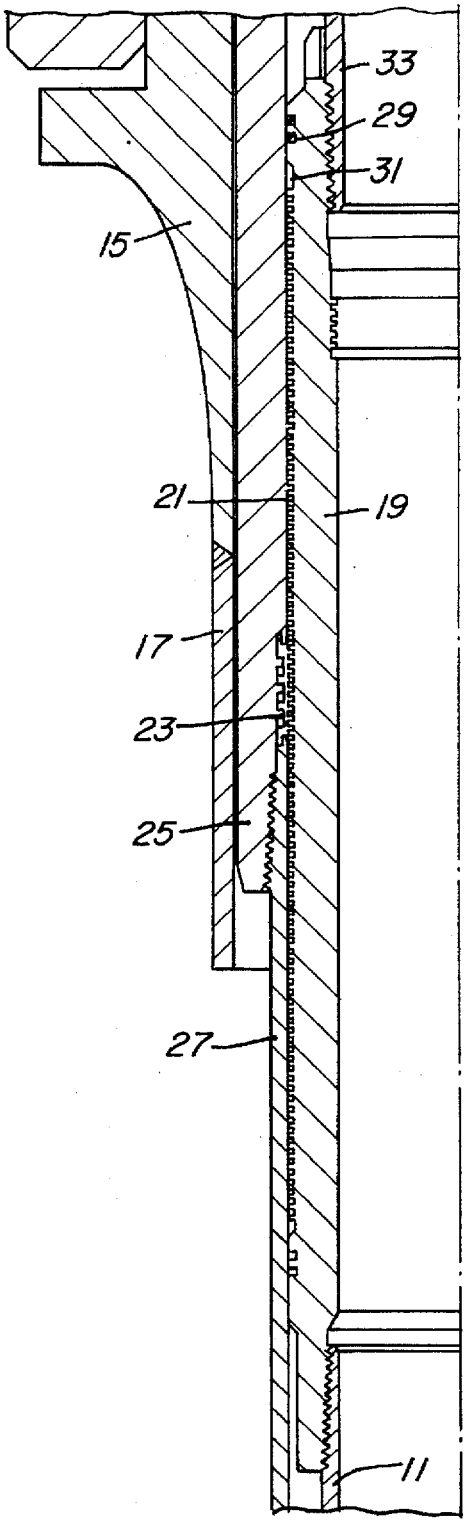
FIG. 4 is an enlarged partial sectional view of the wellhead system of FIG. 1, showing the casing tensioned.

Casing hanger 39 has an external conical load shoulder 43 which has vertical flowby channels. Load shoulder 43 will land on an internal load shoulder 45 located in surface wellhead 13. In FIG. 1A, casing hanger portions 25, 39 are extended relative to mandrel 19, with load shoulder 43 spaced above load shoulder 45. FIGS. 2 and 3 show load shoulder 43 landed on load shoulder 45.

A latch 47 is carried by casing hanger 39. Latch 47, as shown in FIG. 3, is a split ring that is biased outward. Latch 47 has an upward facing shoulder 48 which engages a downward facing shoulder in a recess 49. Recess 49 is formed in surface wellhead 13 above internal load shoulder 45. The distance is selected so that latch 47 will latch to recess 49 when external load shoulder lands on internal load shoulder 45.

Referring to FIG. 2, during the procedure of installing the tieback string 11, a riser 51 will be secured to the upper end of surface wellhead 13. Riser 51 includes a blowout preventer 53, shown schematically, and extends the 90 foot distance to the rig floor. Blowout preventer 53 will be capable of closing around running string conduit 33 to provide a sealed annulus 54. A fluid line 55 leads from pumps (not shown) on the platform to a point below blowout preventer 53 for pumping fluid under pressure to annulus 54.

After casing hanger 39 has landed on internal load shoulder 45, as shown in FIG. 3, a conventional annulus seal 57 will be installed between casing hanger 39 and bore 37 of surface wellhead 13. Annulus seal 57 is retained by a retainer sleeve 59 in the embodiment shown.

In operation, surface wellhead 13 will be installed at the well deck on the platform and connected to the subsea wellhead by riser conductor 17. A riser 51 with a blowout preventer 53 will be secured to and extend upward from surface wellhead 13. The operator will make up a tieback string 11 comprising sections of casing and lower it through riser 51, surface wellhead 13 and conductor 17. As the lower end of tieback string 11 approaches the subsea wellhead, the operator will secure mandrel 19 and conduit 33 to the upper end of tieback string 11. When doing so, the operator will mount the casing hanger comprising the lower extension 25 and upper portion 39 to the mandrel 19. The ratchet ring 23 will initially be in an upper position, at the upper end of mandrel grooves 21. Casing hanger portions 25, 39 will thus be extended relative to mandrel 19.

The operator lowers the assembly further into the well. The dimensions are selected so that when the tieback mechanism on the lower end of tieback string 11 reaches the subsea wellhead housing, the external load shoulder 43 will be spaced a considerable distance above internal load shoulder 45, as shown in FIG. 1A. Preferably, external load shoulder 43 will be located within bore 37, however. Outer seal 35 will be sealed against lower extension 25, and inner seals 41 will be sealed against conduit 33.

The operator will make up the tieback in a conventional manner, normally by rotation. Then, the operator will close the blowout preventer 53 (FIG. 2). The operator pumps liquid down line 55, creating hydraulic pressure in annulus 54. Note that annulus seal 57 will not be in place at this point. The hydraulic pressure acts between the outer seal 35 and the inner seals 41. This creates a piston on the upper casing hanger portion 39, forcing the casing hanger portions 39, 25 downward relative to mandrel 19. Ratchet ring 23 will ratchet downward on grooves 21. Downward movement is stopped by the contact of external load shoulder 43 on internal load shoulder 45. At this point, latch 47 will spring outward into recess 49, locking casing hanger portions 25, 39 in a landed position as shown in FIGS. 2 and 3.

The operator then removes pressure in annulus 54 and opens blowout preventer 53. The operator may at that point set annulus seal 57 in place using a conventional running tool lowered through the blowout preventer 53. The running tool engages retainer sleeve 59 during the installation and then will be retrieved. The operator may then pull upward on conduit 33 with the drill rig elevators, creating tension in tieback string 11. As the operator pulls upward, mandrel 19 will move upward relative to casing hanger portions 25, 39. Ratchet ring 23 ratchets as mandrel 19 moves upward. Latch ring 47 maintains external shoulder 43 in contact with internal load shoulder 45.

When the operator reaches the desired amount of pull, he will slack off the pull with the elevators. Ratchet ring 23 will not allow downward movement of mandrel 19 relative to casing hanger lower extension 25. Tension will be maintained in tieback string 11 by the ratchet ring 23, with the load being transmitted to surface wellhead housing 13 through the load shoulders 43 and 45. The operator will then remove riser 51, cut off conduit 33 above upper casing hanger portion 39, and install the next wellhead housing spool in a conventional manner. The interiors of conduit 33, mandrel 19, and tieback string 11 are sealed by metal seals at their threaded connections. Conductor 17 seals the exterior, and as the annulus between tieback string 11 and conductor 17 is dead, seals 35, 41 have no further purpose.

Another embodiment of a wellhead system constructed in accordance with this invention is shown in FIGS. 6–10. Referring to FIG. 6A, surface wellhead 61 has an internal load shoulder or stop surface 63. Load shoulder 63 is located in the bore of surface wellhead 61. Conduit 65 extends through surface wellhead 61 and in the preferred embodiment comprises a string of drill pipe.

Figure 8A:
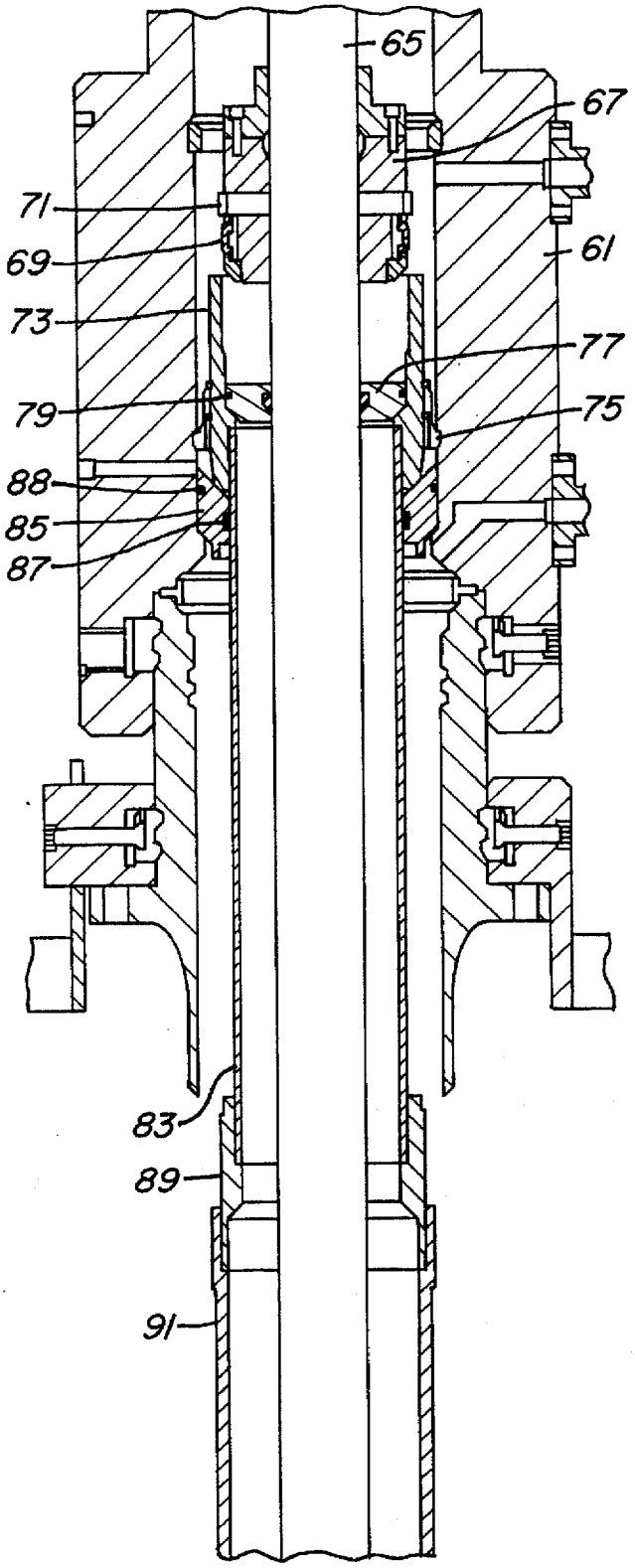
FIGS. 8A and 8B comprise a sectional view of the wellhead system of FIGS. 6A and 6B, showing the casing hanger landed and tension being applied.
Figure 8B:
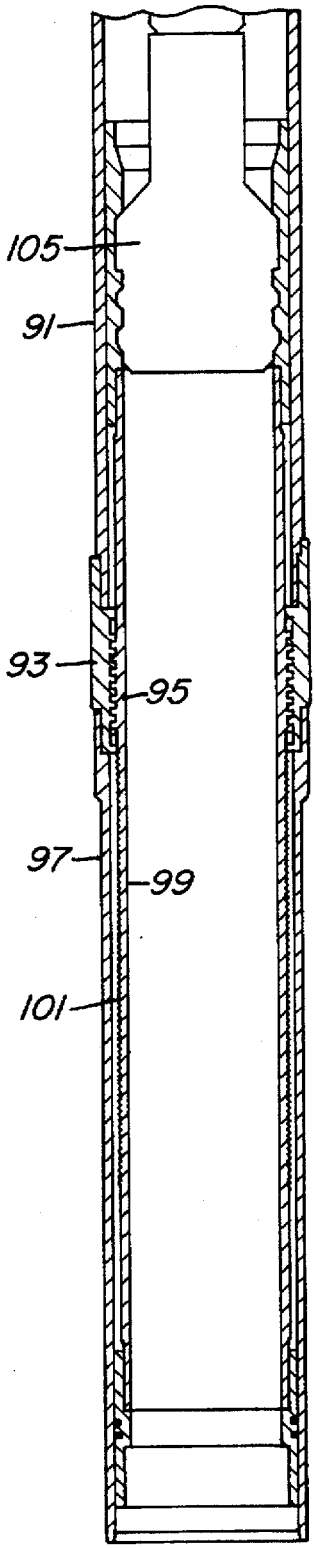
Figure 9:
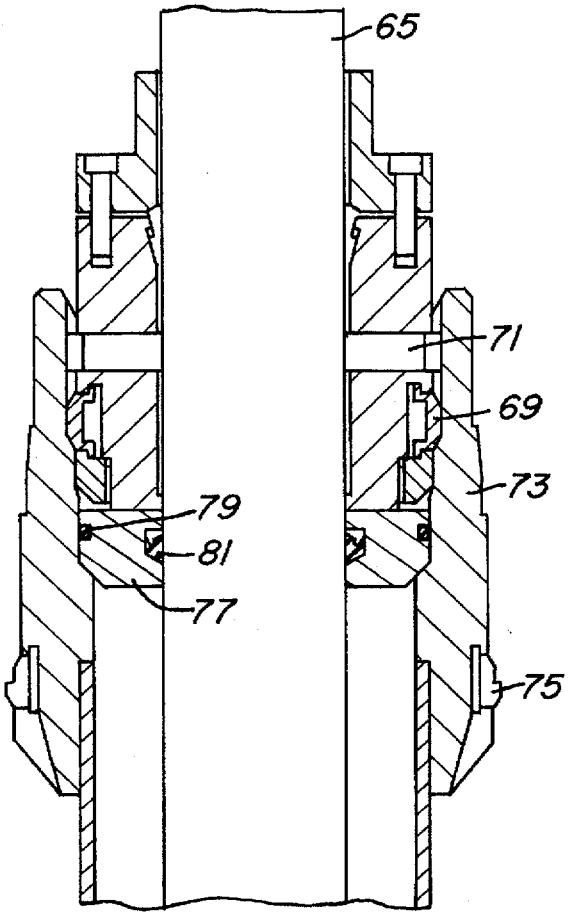
FIG. 9 is an enlarged partial sectional view of the upper running tool portion of FIGS. 6A and 6B.

A retainer tool or upper running tool 67 is rigidly secured to conduit 65 by a clamp so that it will move use in unison with it. Upper running tool 67 is a tubular body that has a split ring 69 encircling it and a pair of keys 71, as shown in FIG. 9. Split ring 69 and keys 71 insert into the bowl of a casing hanger 73. Split ring 69 will provide a releasable attachment to support the weight of casing hanger 73 and the string below. With sufficient upward pull after casing hanger 73 has latched into surface wellhead 61, upper running tool 67 will release from casing hanger 73, as shown in FIG. 8A. Keys 71 provide resistance to rotation of conduit 65 relative to casing hanger 73. Keys 71 will transmit limited torque, but not enough for casing make up.

Casing hanger 73 has an external latch 75 that will latch into a groove 76 in the bore of surface wellhead 61 to retain casing hanger 73 against upward force. Casing hanger 73 is sealed to conduit 65 by an inner seal which includes a separate metal seal body 77 having seals 79 and 81 on its outer and inner diameters. Seal 81 sealingly engages conduit 65 but allows sliding movement. Seal 79 sealingly engages the bowl of casing hanger 73. Seal body 77 is retrieved along with conduit 65 after the installation has been completed.

Casing hanger 73 has a lower extension which in the preferred embodiment includes an upper extension pipe 83. Extension pipe 83 extends downward and comprises a section of pipe having an inner diameter that will be the same as the tieback string of casing. A shoulder ring 85 will land on load shoulder 63 in the bore of surface wellhead 61 when the assembly is lowered into surface wellhead 61. Shoulder ring 85 is a metal ring that has a conical upward facing load shoulder. Shoulder ring 85 also serves as an outer seal having seals 87 and 88 on its inner and outer diameters. Seal 87 sealingly and slidingly engages extension pipe 83. Seal 88 sealingly engages the bore of surface wellhead 61.

The lower extension of casing hanger 73 also includes a coupling 89 and a lower extension pipe 91. Lower extension pipe 91 in the embodiment shown has a larger diameter then upper extension pipe 83. Lower extension pipe 91 extends downward to a ratchet body 93, shown in FIG. 6B. A ratchet ring 95 is carried in ratchet ring body 93. Ratchet ring 95 and ratchet body 93 are the same as shown in the first embodiment, illustrated in detail in FIG. 5. A tubular lower guide 97 extends downward from ratchet body 93.

A mandrel 99 is carried within lower extension pipe 91 and lower guide 97. Mandrel 99 is a tubular member with grooves 101 on its exterior which engage ratchet ring 95. As in the first embodiment, ratchet ring 95 allows upward movement of mandrel 99 relative to lower extension pipe 91, but does not allow downward movement during operation. The lower end of mandrel 99 will be connected to a string of tieback casing which extends downward and connects into a subsea wellhead.

Figure 10:
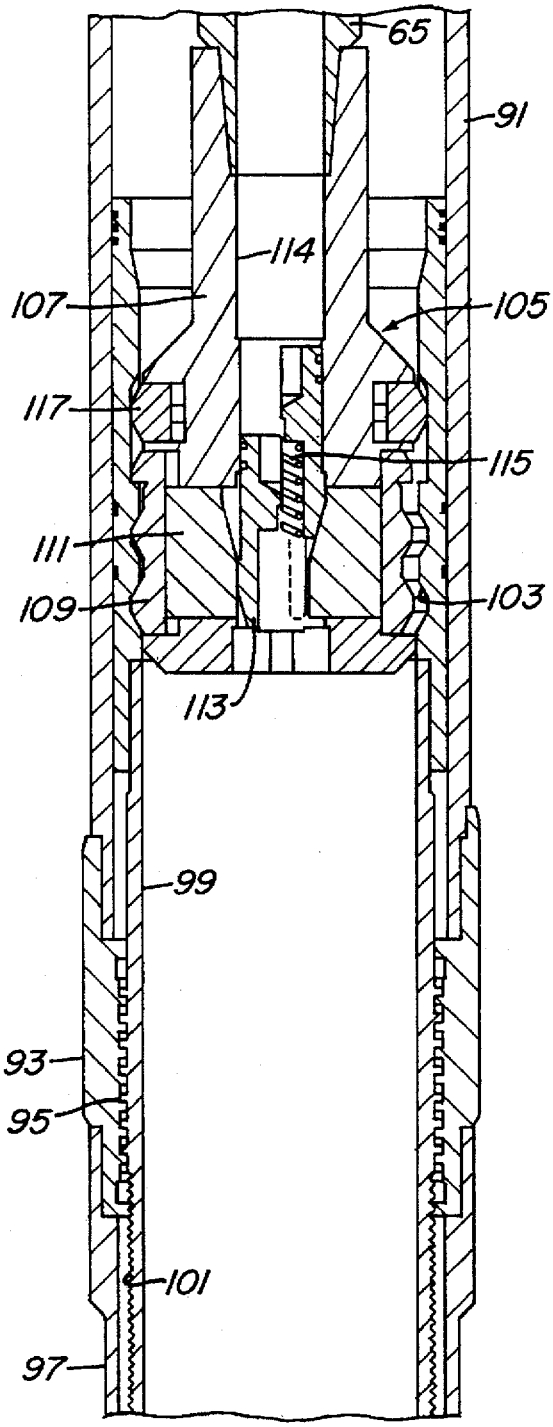
FIG. 10 is an enlarged partial sectional view of the wellhead system of FIGS. 6A and 6B, showing a lower running tool portion.

Mandrel 99 has an upper portion which has a grooved profile 103. A lower running tool 105 is connected to conduit 65 and engages profile 103. As shown in FIG. 10, lower running tool 105 will releasably grip profile 103 as well as transmit torque. Lower running tool 105 includes a body 107 which secures to the lower end of conduit 65. A plurality of dogs 109 having exterior profiles will move outward into engagement with profile 103. A cam 111 pushes dogs 109 outward into engagement. Cam 111 moves from a retracted position to an outward engaged position by downward movement of a piston 113. Piston 113 is sealed in the bore 114 of body 107. A spring 115 urges piston 113 upward. Applying hydraulic pressure to the interior of conduit 65 forces piston 113 downward, pushing dogs 109 out into engagement with profile 103. The contour of profile 103 is selected so that applying an upward force to conduit 65 to lift mandrel 99 will provide enough frictional engagement so that the hydraulic pressure on piston 113 may be removed without causing dogs 109 to retract. As long as an upward force is continually applied, dogs 109 will remain in engagement with profile 103.

Figure 6A:
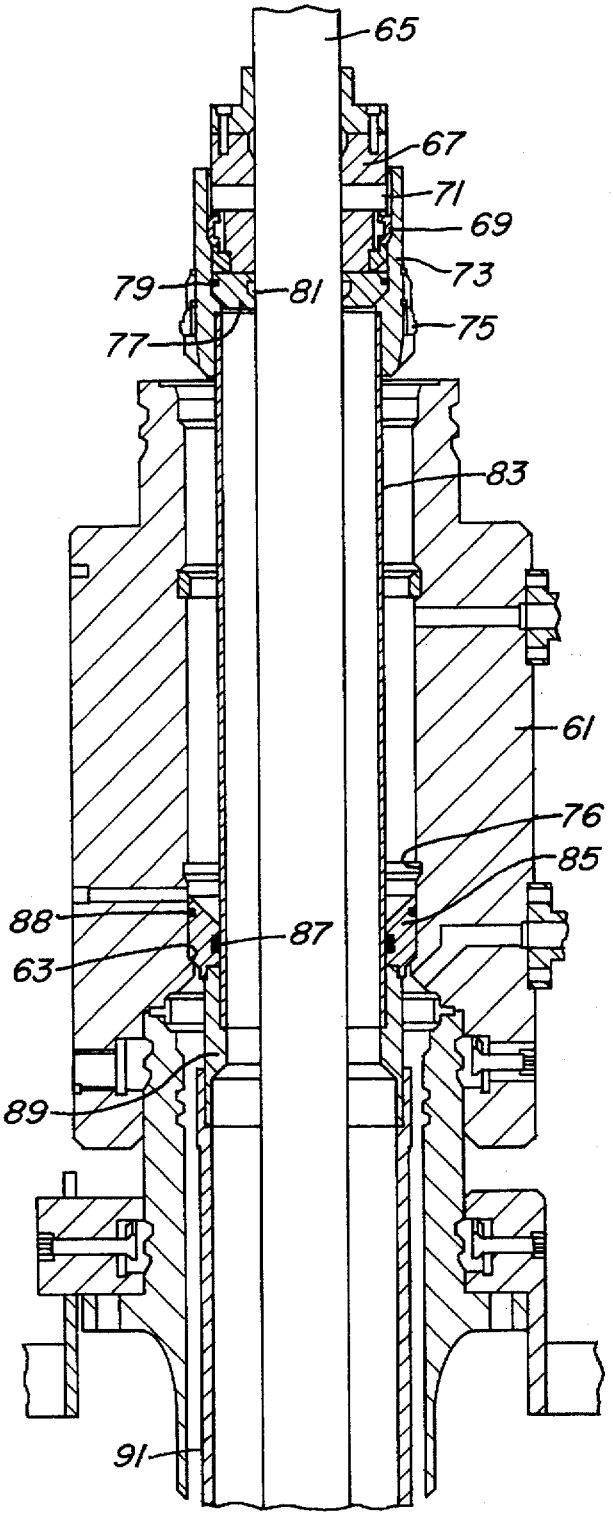
FIGS. 6A and 6B comprise a vertical sectional view of an alternate embodiment of a wellhead system constructed in accordance with this invention, and shown in a running-in position.

In the operation of the embodiment of FIGS. 6A–10, the assembly will be made up at the upper end of a string of tieback casing. Lower running tool 107 will be energized by hydraulic pressure within the interior of conduit 65 to cause dogs 109 to frictionally engage profile 103. Upper running tool 67 will be placed in engagement with the bowl of casing hanger 73 (FIG. 6A). Shoulder ring 85 will be connected to coupling 89 by a shear pin. The assembly is lowered into the well on conduit 65. First, shoulder ring 85 will land on load shoulder 63, as shown in FIG. 6A. At this point, the tieback connector (not shown) at the lower end of the tieback casing will be spaced above the subsea wellhead.

Figure 6B:
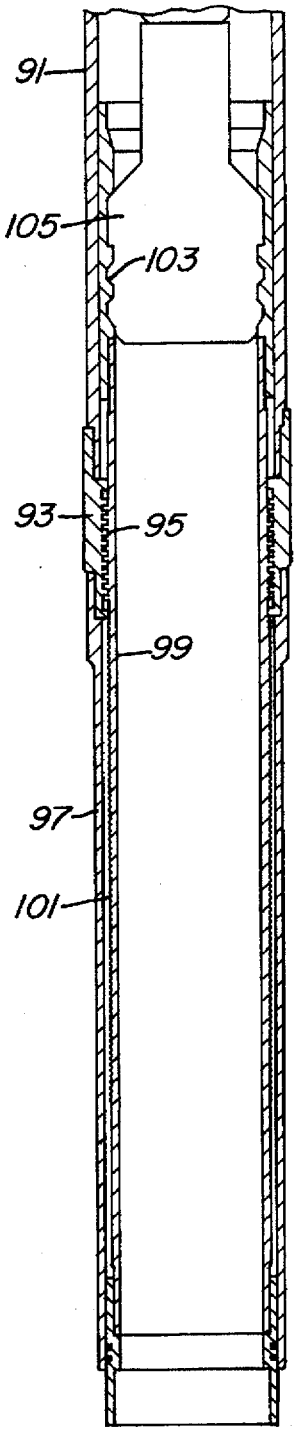
Figure 7A:
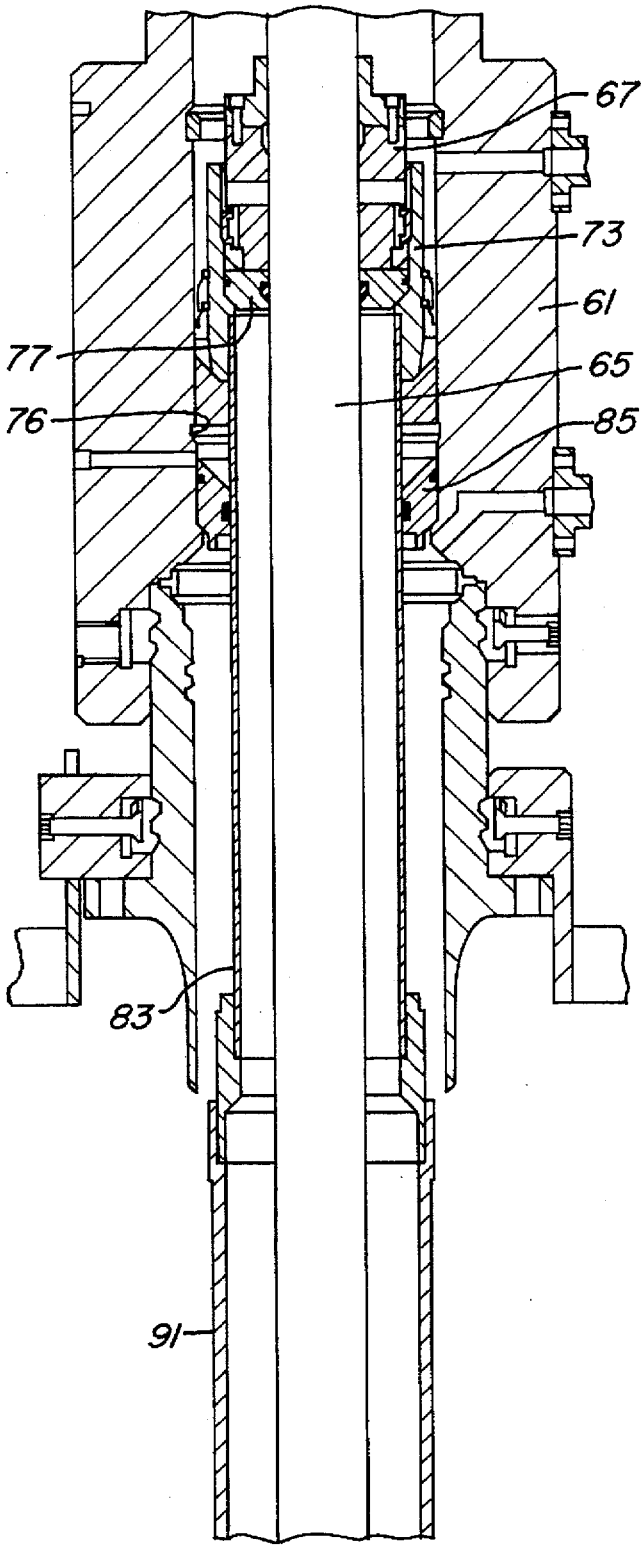
FIGS. 7A and 7B comprise a vertical sectional view of the wellhead system of FIGS. 6A and 6B, but showing the system in the process of tying back to a subsea wellhead.
Figure 7B:
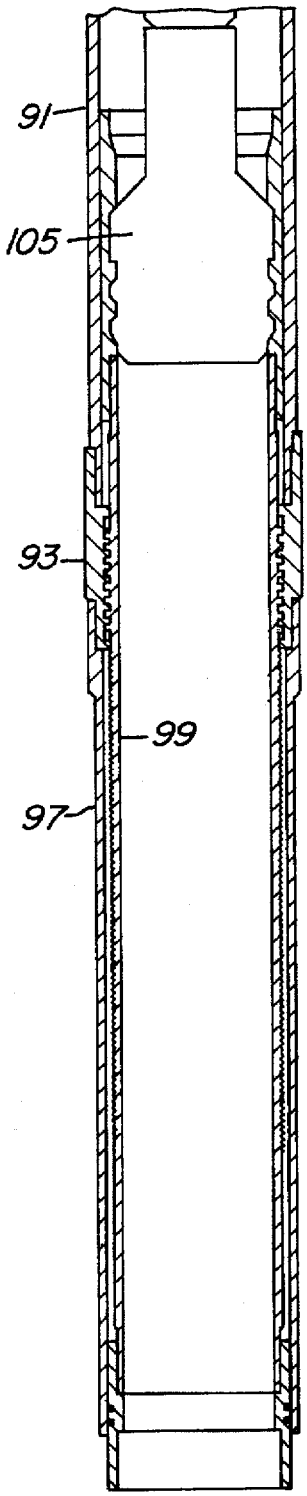

Continued downward movement from the position shown in FIGS. 6A and 6B causes the shear pin between shoulder ring 85 and coupling 89 to shear. Upper and lower running tools 67, 105 continue to move downward, as shown in FIGS. 7A and 7B. The dimensions of the tieback casing and extension pipes 83, 91 are selected so that the distance at this point from casing hanger 73 to the lower tieback connector is greater than the distance from the subsea wellhead tieback connector to the load shoulder on shoulder ring 85. Consequently, securing the lower tieback connection into the subsea wellhead is performed while casing hanger 73 is spaced above shoulder ring 85, as shown in FIG. 7A. The tieback is performed conventionally by rotation of conduit 65, which through keys 117 (FIG. 10) of lower running tool 105, transmits torque to mandrel 99 and the tieback casing.

The operator then closes the blowout preventer in the same manner as described in connection with the first embodiment and illustrated schematically in FIG. 2. A piston is created by seals 87, 88 on the outer side of upper extension pipe 83, and seals 79, 81 between conduit 65 and the bore of casing hanger 73. Hydraulic pressure is provided at a level sufficient to overcome the gripping force of snap ring 69. The pressure forces casing hanger 73 downward relative to conduit 65 and upper running tool 67 as shown in FIG. 8A. The hydraulic pressure pumps casing hanger 73 downward until it lands on the load shoulder of shoulder ring 85 and latch 75 snaps into groove 76.

When casing hanger 73 is moving downward, the lower extension comprising upper extension pipe 83 and lower extension pipe 91 will move downward relative to mandrel 99, which is held stationary because it will be previously connected to the subsea wellhead through the tieback casing. Then, the hydraulic pressure is relieved and the blowout preventer is opened. The operator will then pull tension in the tieback string by pulling upward on conduit 65. Lower running tool 105 exerts an upward pull on profile 103, moving mandrel 99 upward relative to lower extension pipe 91. Casing hanger 73 will not move upward because of the latching engagement of latch 75 with groove 76. Ratcheting of ratchet ring 95 occurs on grooves 101 during this upward movement. Once the desired tension has been achieved, the operator can then slack off. Ratchet ring 95 will hold the tension in extension pipes 83, 91, mandrel 99 and the tieback casing.

Once the pull has been slacked off on lower running tool 105, dogs 109 (FIG. 10) will retract, allowing conduit 65 to be pulled upward. When lower running tool 105 contacts seal body 77 it will unseat it from the bowl of casing hanger 73, and retrieve it along with conduit 65.

The invention has significant advantages. The invention allows tensioning of a tieback string through the blowout preventer without the use of a running tool to adjust the load or ratchet ring. The use of hydraulic pressure in the annulus below the blowout preventer moves the casing hanger downward to the load shoulder.

While the invention has been in shown in only two of its forms, it should be apparent to those skilled in the art that it is not so limited but is susceptible to various changes without departing from the scope of the invention. For example, in the second embodiment although the ratchet mechanism and mandrel are shown at the upper end of the tieback string, they could be placed at the lower end where it connects to the subsea wellhead.

I claim:

1. A method for connecting a string of casing between a subsea wellhead and a surface wellhead located on a platform, comprising:

providing an internal load shoulder within the surface wellhead;

attaching a lower end of a mandrel to the string, and engaging an upper end of the mandrel with an upward extending conduit;

providing a casing hanger which has an external shoulder and providing the casing hanger with a lower extension which has an internal gripping member which engages the mandrel to allow upward movement of the mandrel relative to the casing hanger but prevent downward movement of the mandrel relative to the casing hanger;

connecting a riser and a blowout preventer to the surface wellhead and lowering the string through the riser, blowout preventer, and surface wellhead;

sealing between the lower extension and the surface wellhead and sealing between the casing hanger and the conduit in a manner which allows downward sliding movement of the casing hanger and the lower extension relative to the surface wellhead and the conduit;

securing a lower end of the string to the subsea wellhead while the external shoulder of the casing hanger is spaced above the load shoulder; then closing the blowout preventer around the conduit to provide a sealed annulus in the riser below the blowout preventer around the conduit, and applying hydraulic pressure to the annulus which forces the casing hanger and the lower extension downward relative to the mandrel until the external shoulder lands on the load shoulder; then pulling upward on the conduit and the mandrel while maintaining the external shoulder of the casing hanger on the load shoulder to apply tension to the string, and once a desired amount of tension is reached, relaxing the pull, causing the gripping member to grip the mandrel to support the string in tension.

2. The method according to claim 1, wherein the step of maintaining the casing hanger on the load shoulder while pulling upward on the conduit is performed while landing the external shoulder on the load shoulder by latching the casing hanger to a groove formed in the surface wellhead.

3. The method according to claim 1, further comprising:

removing the hydraulic pressure; and installing an annulus seal between the casing hanger and the surface wellhead.

4. The method according to claim 1, wherein the step of providing an internal load shoulder comprises:

providing a stop surface within the surface wellhead;

mounting a load shoulder ring to the lower extension for axial sliding movement, and landing the ring on the stop surface while lowering the string into the surface wellhead, the ring having an upper surface which serves as the internal load shoulder; and wherein the step of sealing between the lower extension and the surface wellhead comprises:

sealing an inner diameter of the ring to the lower extension, and sealing an outer diameter of the ring to the surface wellhead.

5. The method according to claim 1 wherein the step of engaging an upper end of the mandrel with the conduit comprises:

providing a lower running tool which has radially retractable and extendable locking members;

securing the running tool to a lower end of the conduit, inserting the running tool into the mandrel, and extending the locking members into engagement with a locking profile formed in the mandrel; and wherein the method further comprises:

retracting the locking members from engagement with the profile in the mandrel and retrieving the lower running tool after tension has been applied to the string.

6. The method according to claim 1 wherein the step of engaging an upper end of the mandrel with the conduit comprises:

providing a lower running tool which has radially retractable and extendable locking members and a torque transmitting key;

securing the running tool to a lower end of the conduit, inserting the running tool into the mandrel, extending the locking members into engagement with a locking profile formed in the mandrel and the key into engagement with a slot formed in the mandrel; wherein the step of securing a lower end of the string to the subsea wellhead comprises:

rotating the conduit and through the key rotating the mandrel and the lower end of the string; and wherein the method further comprises:

retracting the locking members from engagement with the profile in the mandrel and retrieving the lower running tool after tension has been applied to the string.

7. The method according to claim 6 wherein the step of sealing between the casing hanger and the conduit comprises:

mounting a seal body to the conduit for axial sliding movement relative to the conduit and to the casing hanger; and sealing an inner diameter of the seal body to the conduit and an outer diameter of the seal body to the casing hanger.

8. In an offshore well system having a subsea wellhead and a surface wellhead which is located on a platform, the system having a removable riser with a blowout preventer extending upward from the surface wellhead, the improvement comprising in combination:

an internal load shoulder located in the surface wellhead;

a tubular mandrel having a lower end which is secured to a section of tieback casing;

a casing hanger having an external shoulder;

a tubular extension pipe secured to the casing hanger and extending downward around the mandrel;

gripping means between the extension pipe and the mandrel for allowing upward movement of the mandrel relative to the extension pipe but preventing downward movement of the mandrel relative to the extension pipe;

a conduit which extends upward from the mandrel through the extension pipe and the surface wellhead; and means for sealing between the extension pipe and the surface wellhead and sealing between the casing hanger and the conduit in a manner which allows downward movement of the casing hanger relative to the mandrel in response to hydraulic pressure; whereby the blowout preventer may be closed around the conduit to provide a sealed annulus in the riser below the blowout preventer around the conduit, so that hydraulic pressure may be applied to the annulus to force the casing hanger and the extension pipe downward relative to the mandrel onto the load shoulder; and wherein, the conduit and mandrel may be pulled upward relative to the casing hanger and the extension pipe after securing the lower end of the tieback casing to the subsea wellhead to apply tension to the tieback casing and the extension pipe, so that the gripping means can grip the mandrel to support the tieback casing and the extension pipe in tension once a desired amount of tension is reached.

9. The well system according to claim 8, wherein the means for sealing comprises:

an inner seal located between the casing hanger and the conduit; and an outer seal located between the extension pipe and the surface wellhead.

10. The well system according to claim 8, wherein the gripping means comprises:

a plurality of circumferentially extending parallel grooves on an exterior portion of the mandrel; and a ratchet ring carried by the extension pipe which ratchets on the grooves as the extension pipe moves downward relative to the mandrel and while the mandrel is pulled upward relative to the casing hanger, but engages the grooves to support a load when the mandrel attempts to move downward relative to the extension pipe.

11. The well system according to claim 8, further comprising:

latch means for latching the casing hanger to the surface wellhead with the external shoulder in contact with the load shoulder.

12. The well system according to claim 8, further comprising:

an internal recess formed in the surface wellhead; and a split latch ring mounted to the casing hanger for engaging the recess to hold the external shoulder in contact with the load shoulder while the mandrel is being pulled upward to tension the string.

13. The well system according to claim 8, further comprising:

an annulus seal which is installed between the casing hanger and the surface wellhead after the external shoulder lands on the load shoulder.

14. The well system according to claim 8, wherein the internal load shoulder comprises:

a stop surface formed in the surface wellhead; and a load shoulder ring mounted to the conduit for axial sliding movement, the ring landing on the stop surface when the conduit is lowered through the surface wellhead; and wherein the means for sealing between the extension pipe and the surface wellhead comprises:

a seal mounted to an inner diameter of the ring in sealing engagement with the extension pipe; and a seal mounted to an outer diameter of the ring in sealing engagement with the surface wellhead.

15. In an offshore well system having a subsea wellhead and a surface wellhead which is located on a platform, a removable riser string and a blowout preventer extending upward from the surface wellhead, the improvement comprising in combination:

an internal load shoulder located in the surface wellhead;

a tubular mandrel having a lower end which is secured to an upper end of a section of tieback casing, the mandrel having a plurality of circumferentially extending external grooves;

a casing hanger having an external shoulder and an extension pipe which extends downward from the casing hanger and surrounds at least an upper portion of the grooves of the mandrel;

a ratchet ring carried by the extension pipe in engagement with the grooves on the mandrel;

a conduit which extends upward from the mandrel through the extension pipe and the surface wellhead;

an inner seal located between the casing hanger and the conduit;

an outer seal located between the extension pipe and the surface wellhead;

the casing hanger and the extension pipe having an extended position relative to the mandrel while the string is lowered through the riser and blowout preventer and secured to the subsea wellhead, the extended position locating the external shoulder of the casing hanger above the load shoulder while the lower end of the string is securing to the subsea wellhead;

means for applying hydraulic pressure to an annulus in the riser around the conduit above the inner and outer seals and below the blowout preventer while closed to force the casing hanger and the extension pipe from the extended position downward relative to the mandrel onto the load shoulder; and latch means for holding the external shoulder of the casing hanger on the load shoulder, allowing the conduit and mandrel to be pulled upward to apply tension to the extension pipe and the tieback casing, so that the gripping means can grip the mandrel to support the extension pipe and the tieback casing in tension once a desired amount of tension is reached.

16. The well system according to claim 15, further comprising:

an annulus seal which is installed between the casing hanger and the surface wellhead after the external shoulder of the casing hanger lands on the load shoulder.

17. The well system according to claim 15, wherein the inner seal comprises:

an inner seal body slidably mounted to the conduit;

a seal on an inner diameter of the inner seal body in sealing engagement with the conduit; and a seal on an outer diameter of the inner seal body in sealing engagement with the casing hanger.

18. The well system according to claim 15, wherein the internal load shoulder comprises:

a stop surface formed in the surface wellhead; and a load shoulder ring mounted to the conduit for axial sliding movement, the ring landing on the stop surface when the conduit is lowered through the surface wellhead; and wherein the means for sealing between the extension pipe and the surface wellhead comprises:

a seal mounted to an inner diameter of the ring in sealing engagement with the extension pipe; and a seal mounted to an outer diameter of the ring in sealing engagement with the surface wellhead.

19. The well system according to claim 15, wherein the latch means comprises:

an internal recess formed in the surface wellhead; and a split latch ring mounted to the casing hanger for engaging the recess.

* * * * *